US008608488B2

(12) United States Patent
Lin et al.

(10) Patent No.: US 8,608,488 B2
(45) Date of Patent: Dec. 17, 2013

(54) CONDUCTIVE TERMINAL WITH A CENTRAL BULGED PORTION CONFIGURED FOR SWINGING RELATIVE TO A BASE MATERIAL

(75) Inventors: Kuo-Hua Lin, Hsin-Chu (TW); Tsung-Yen Yang, Hsin-Chu (TW); Chien-Hsien Lu, Hsin-Chu (TW); Yeh Sung, Hsin-Chu (TW)

(73) Assignees: Aptos Technology Inc., Hsin-Chu (TW); Topmore Technology Inc., Hsinchu County (TW)

( * ) Notice: Subject to any disclaimer, the term of this patent is extended or adjusted under 35 U.S.C. 154(b) by 16 days.

(21) Appl. No.: 13/539,504

(22) Filed: Jul. 2, 2012

(65) Prior Publication Data

US 2013/0203297 A1 Aug. 8, 2013

(30) Foreign Application Priority Data

Feb. 3, 2012 (TW) ..... 101202005 A
Mar. 28, 2012 (TW) ..... 101205620 A

(51) Int. Cl.
*H01R 39/00* (2006.01)

(52) U.S. Cl.
USPC ..... 439/19

(58) Field of Classification Search
USPC ..... 439/660, 11–19
See application file for complete search history.

(56) References Cited

U.S. PATENT DOCUMENTS

| | | | | |
|---|---|---|---|---|
| 5,621,196 | A * | 4/1997 | Nishijima et al. | 200/6 A |
| 6,582,237 | B2 * | 6/2003 | Jacobson | 439/19 |
| 6,896,522 | B2 * | 5/2005 | Harasawa | 439/17 |
| 6,921,269 | B2 * | 7/2005 | Johnson et al. | 439/13 |
| 7,445,467 | B1 * | 11/2008 | Matsuo | 439/74 |
| 7,802,992 | B2 * | 9/2010 | Niitsu et al. | 439/19 |
| 7,811,091 | B2 * | 10/2010 | Koyama | 439/17 |

* cited by examiner

*Primary Examiner* — Chandrika Prasad
(74) *Attorney, Agent, or Firm* — Jianq Chyun IP Office

(57) ABSTRACT

A portable electronic device includes a base material, a fixing-cover and conductive terminals. The base material has first contact-pads and second contact-pads. The fixing-cover is disposed on a first surface and exposes the first contact-pads. The fixing-cover has a clamp portion. The terminals are disposed on the second contact-pads, wherein a first end of each the terminal extends out of the fixing-cover. A second end leans against the fixing-cover. A central portion is located between the two ends, wherein the bottom of the central portion bulges and contacts the corresponding second contact-pad, and the two ends can swing relatively to the base material around the bottom of the central portion as the pivot. The central portion has a positioning portion formed in direction facing the opening and the positioning portion is embedded in the opening.

11 Claims, 11 Drawing Sheets

300

CONDUCTIVE TERMINAL WITH A CENTRAL BULGED PORTION CONFIGURED FOR SWINGING RELATIVE TO A BASE MATERIAL

CROSS-REFERENCE TO RELATED APPLICATION

This application claims the priority benefits of Taiwan application serial no. 101202005, filed on Feb. 3, 2012, and Taiwan application serial no. 101205620, filed on Mar. 28, 2012. The entirety of each of the above-mentioned patent applications is hereby incorporated by reference herein and made a part of specification.

BACKGROUND

1. Field of the Invention

The invention generally relates to a portable electronic device, and more particularly, to a portable electronic device compatible with the architectures of universal serial bus (USB) 3.0 and USB 2.0.

2. Description of Related Art

The USB interface is a common hot-plug interface adopted by electronic apparatuses available on the existing market. To respond the demand of high data transmission volume and high transmission rate, the signal transmission specification of a USB is also evolved from USB 2.0 to USB 3.0. In comparison with the conventional USB 2.0 with 480M bps transmission rate, the transmission rate of the USB 3.0 can reach 5G bps, which largely increase the speed of data transmission.

The transmission interface of a portable electronic device has two sets of contact-pads, one set serves as USB 2.0 transmission lead, while another set would contact terminals to serve as USB 3.0 transmission lead, so as to form a transmission interface compatible with USB 2.0/3.0. Therefore, when the contact between a terminal and a contact-pad is poor, the transmission rate of the portable electronic device is reduced and further the data transmission stability of the portable electronic device is not ensured.

SUMMARY

Accordingly, the present invention is directed to a portable electronic device able to keep effective contact between the conductive terminals and the contact-pads and have good reliability.

The present invention provides a portable electronic device, which includes a base material, a fixing-cover and a plurality of conductive terminals. The base material has a first surface and a plurality of first contact-pads and a plurality of second contact-pads both located on the first surface. The fixing-cover is disposed on the first surface and exposes out the first contact-pads, in which the fixing-cover has a clamp portion located over the second contact-pads and the clamp portion has a plurality of openings. The conductive terminals are respectively disposed on the second contact-pads, in which each of the conductive terminals includes a first end, a second end, a central portion and a positioning portion. The first end extends out of the fixing-cover. The second end is configured for leaning against the fixing-cover to withstand a press force towards the corresponding second contact-pad. The central portion is located between the first end and the second end, in which the bottom of the central portion bulges and contacts the corresponding second contact-pad, and the first end and the second end are configured for swinging relatively to the base material around the bottom of the central portion as the pivot. The central portion has a positioning portion formed in the direction facing the opening and the positioning portion is embedded in the opening.

In an embodiment of the present invention, the connection place of the above-mentioned positioning portion and central portion forms a neck portion and the clamp portion extends towards the neck portion.

In an embodiment of the present invention, the above-mentioned fixing-cover includes a plurality of springs respectively pressing the second ends of the conductive terminals.

In an embodiment of the present invention, the above-mentioned fixing-cover further includes a plurality of grooves and the grooves respectively expose the springs and the second terminals of the conductive terminals.

In an embodiment of the present invention, the above-mentioned fixing-cover includes a buffering element and the buffering element is able to elastically press the second ends of the conductive terminals.

In an embodiment of the present invention, the above-mentioned fixing-cover and the springs are integrated formed.

In an embodiment of the present invention, the above-mentioned fixing-cover further includes a groove and the buffering element is located in the groove.

In an embodiment of the present invention, the above-mentioned fixing-cover further includes a fixing element and the fixing elements respectively press the buffering element to fix the buffering element into the groove.

In an embodiment of the present invention, the above-mentioned fixing-cover further includes at least one extension portion, each of the extension portions is disposed in the groove, each of the extension portions has a guiding inclined surface, and the buffering element is configured for entering the groove through the guiding of the guiding inclined surface.

In an embodiment of the present invention, the surface of the above-mentioned positioning portion is a curve surface.

In an embodiment of the present invention, the above-mentioned portable electronic device further includes a case, in which the case encloses the first contact-pads, the second contact-pads, the conductive terminals and the fixing-cover, the case has a slot and the first contact-pads and the first ends of the conductive terminals are exposed in the slot.

Based on the description above, the invention can avoid the poor contact problem between the conductive terminals and the second contact-pads through an appropriate structure design of the conductive terminals. Both ends of each the conductive terminal herein are designed similar to both ends of a lever and are suitable to swing relatively to the base material around the bottom of the central portion as a pivot. When the portable electronic device is plugged into a transmission receptacle, an external force applied by the transmission receptacle presses an end of the conductive terminal to make the conductive terminal and the second contact-pad keep close contact. In addition, the contact area between the conductive terminal and the second contact-pad is increased along with the increasing applied force so as to advance the transmission rate of the portable electronic device and further ensure the data transmission stability thereof.

Other objectives, features and advantages of the invention will be further understood from the further technological features disclosed by the embodiments of the invention wherein there are shown and described preferred embodiments of this invention, simply by way of illustration of modes best suited to carry out the invention.

DESCRIPTION OF THE EMBODIMENTS

Figure 1:
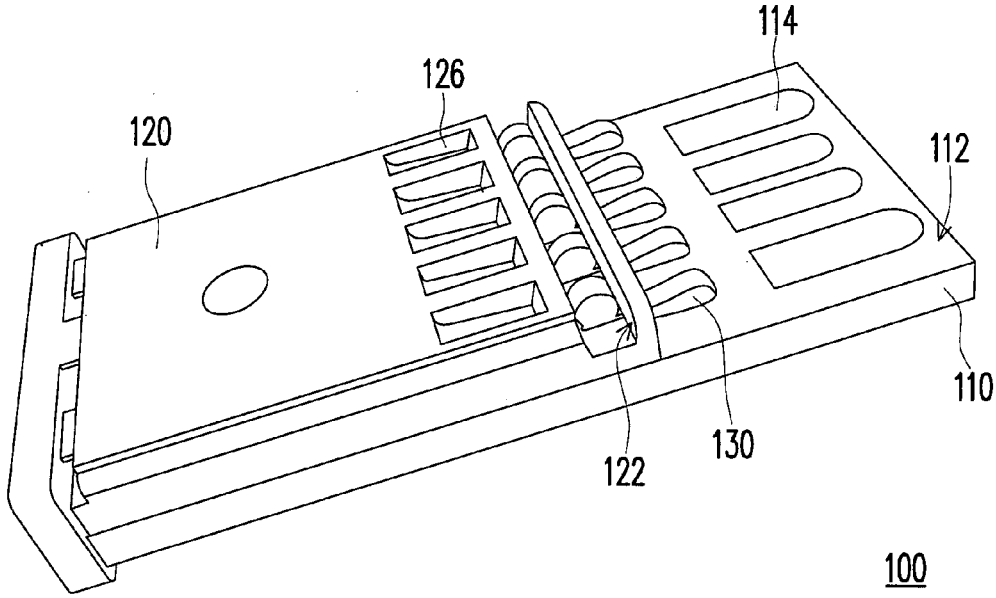
FIG. 1 is a diagram of a three-dimensional diagram of a portable electronic device according to an embodiment of the present invention.
Figure 2:
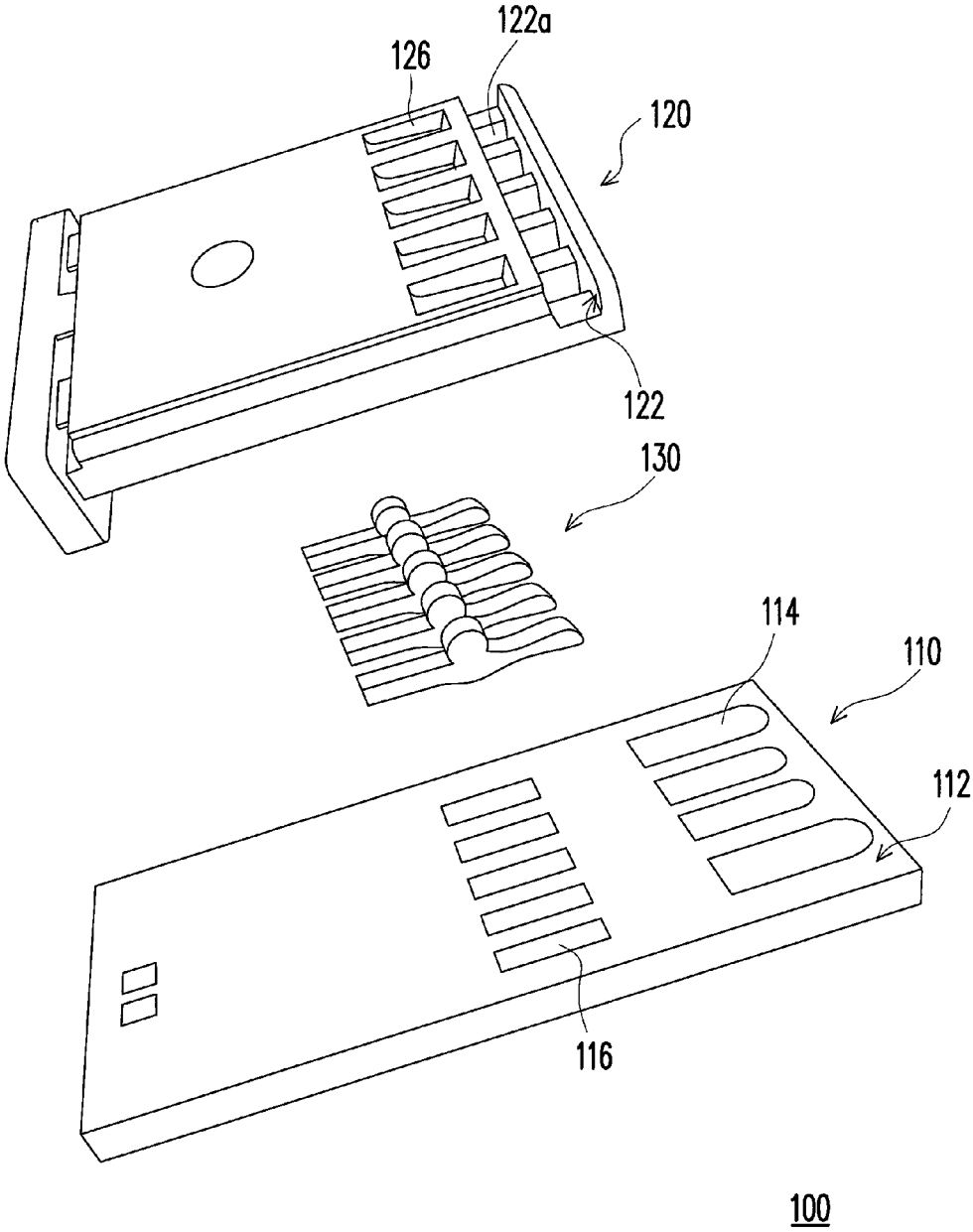
FIG. 2 is an exploded diagram of the portable electronic device of FIG. 1.

FIG. 1 is a diagram of a three-dimensional diagram of a portable electronic device according to an embodiment of the present invention and FIG. 2 is an exploded diagram of the portable electronic device of FIG. 1. Referring to FIGS. 1 and 2, a portable electronic device 100 of the embodiment is compatible with the USB 2.0/3.0 transmission interface and includes a base material 110, a fixing-cover 120 and a plurality of conductive terminals 130 (five terminals are shown in the figures).

The base material 110 has a first surface 112 and the base material 110 includes a plurality of first contact-pads 114 and a plurality of second contact-pads 116 both located on the first surface 112. The base material 110 of the embodiment includes a substrate, a chip and a circuit therein, in which the first contact-pads 114 and the second contact-pads 116 can be directly fabricated by using the currently existed production flow procedure of USB2.0 on the substrate. The chip is electrically connected to the first contact-pads 114 and the second contact-pads 116 through the circuit in the base material 110. In other embodiments however, the first contact-pads, the second contact-pads and a die pad for carrying the chip can be fabricated without the substrate, instead, by using a patterned metallic layer. After that, the chip is electrically connected to the first contact-pads and the second contact-pads through the circuit. In another embodiment, the base material 110 can be an electronic device having a chip.

Four first contact-pads 114 of the portable electronic device 100 serve as the USB2.0 transmission leads, and the four first contact-pads 114 with other five second contact-pads 116 can together serve as USB 3.0 transmission leads. The second contact-pads 116 of the embodiment are connected to an external female jack via the contacts between the second contact-pads 116 and the conductive terminals 130.

Figure 3:
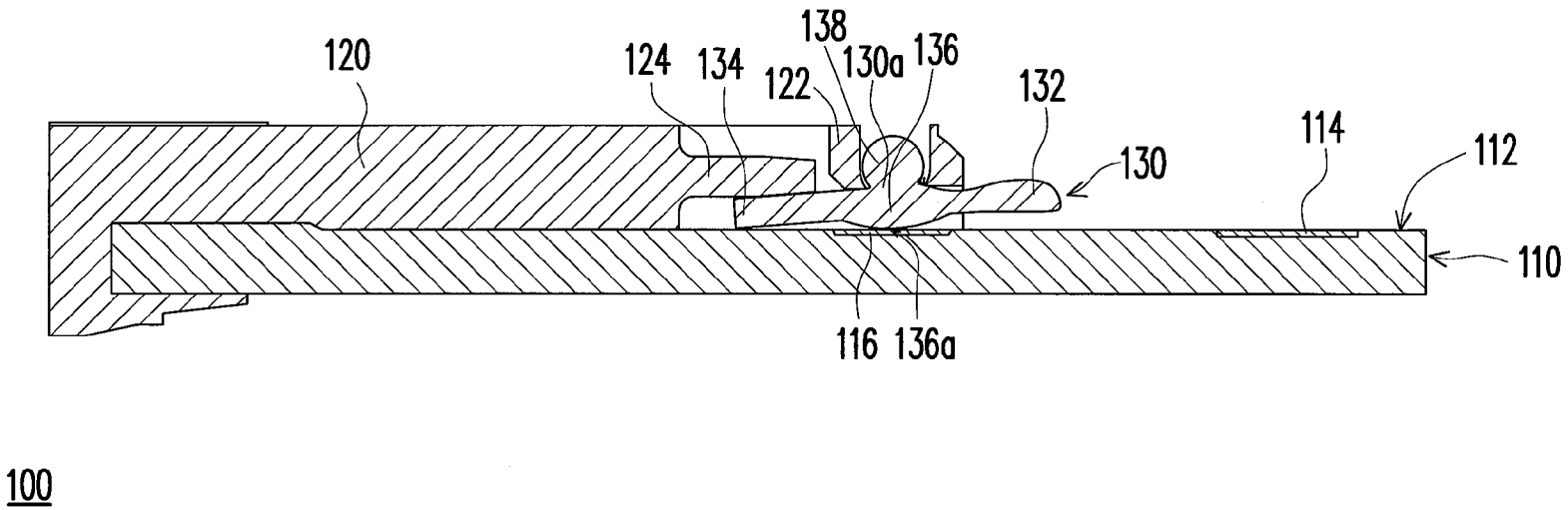
FIG. 3 is a cross-sectional diagram of the portable electronic device of FIG. 1.

FIG. 3 is a cross-sectional diagram of the portable electronic device of FIG. 1. Referring to FIGS. 1-3, in the embodiment, the fixing-cover 120 is disposed on the first surface 112 and exposes out the first contact-pads 114. Each of the conductive terminals 130 is respectively disposed on the second contact-pads 116. The conductive terminal 130 includes a first end 132, a second end 134, a central portion 136 and a positioning portion 138. The first end 132 of the conductive terminal 130 extends out of the fixing-cover 120. A force applied by the fixing-cover 120 presses the second end 134 of the conductive terminal 130 to fix the conductive terminal 130 on the base material 110. The central portion 136 is located between the first end 132 and the second end 134 and the bottom 136*a* of the central portion 136 bulges and contacts the second contact-pad 116.

In addition, the fixing-cover 120 has a clamp portion 122 located over the second contact-pads 116 and having a plurality of openings 122*a*. When the fixing-cover 120 presses each the second end 134 of each the conductive terminal, the positioning portion 138 and the central portion 136 are respectively located at the two opposite sides of the corresponding opening 122*a* and go through the opening 122*a* to connect each other. The fixing-cover 120 is made of material with plasticity and elasticity, for example, plastic, so that even the external diameter of the conductive terminal 130 is greater than the diameter of the opening 122*a*, during assembling, the positioning portion 138 still can go through the opening 122*a* by extrusion way so as to be assembled together with the fixing-cover 120.

The conductive terminals 130 in the embodiment are made of metal and are easily assembled with the fixing-cover 120 by means of the elasticity of the plastic fixing-cover 120. Meanwhile, when the conductive terminals 130 are moved during operation, the conventional poor contact problem between the conductive terminal 130 and the second contact-pads 116 can be avoided by means of the elasticity of the fixing-cover 120. At the connection place between the positioning portion 138 and the central portion 136, there is a neck portion 130*a*. The clamp portion 122 extends towards the neck portion 130*a* to keep the conductive terminal 130 in the clamp portion 122 without easily loosing.

Figure 4:
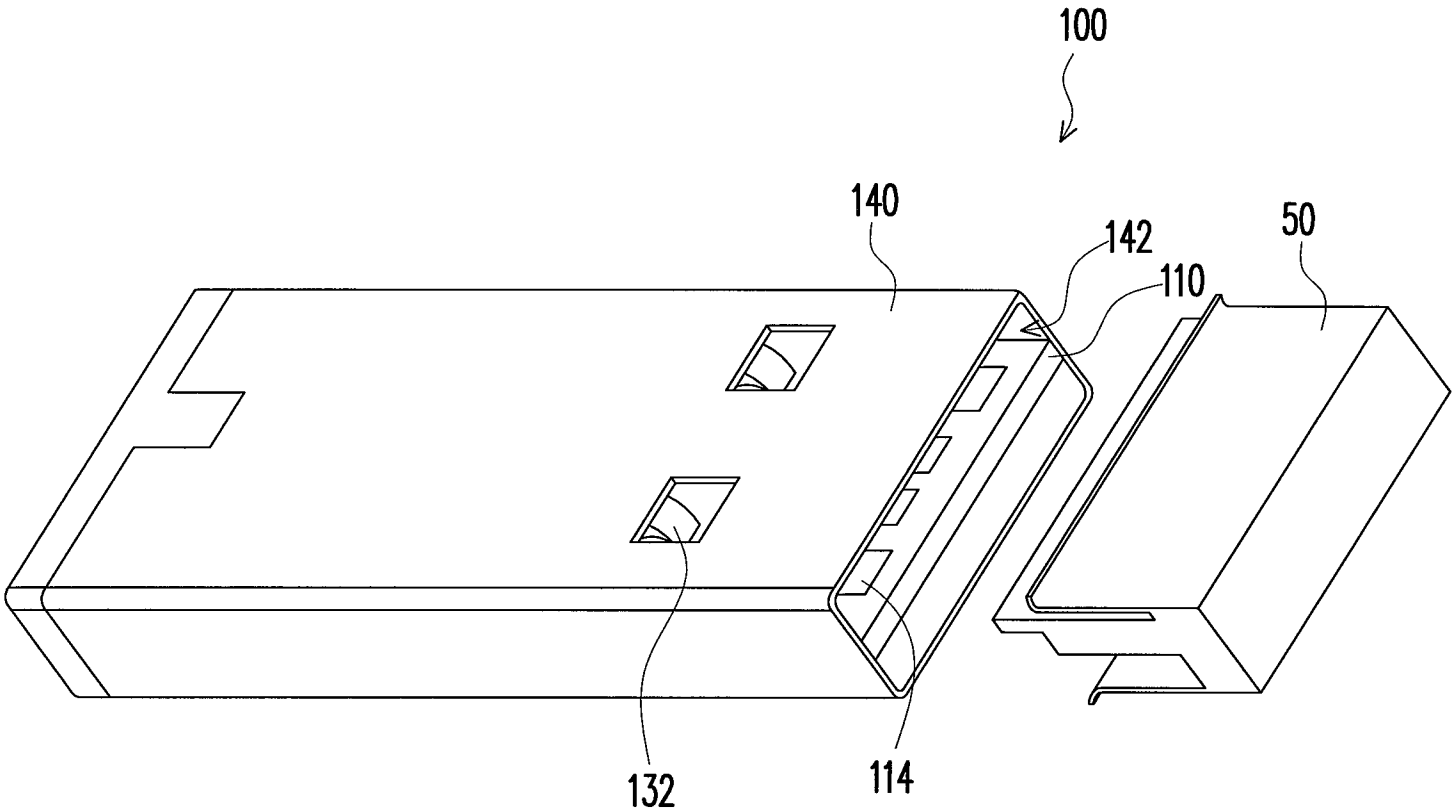
FIG. 4 is a schematic diagram of the portable electronic device of FIG. 1 and the transmission receptacle.

FIG. 4 is a schematic cross-sectional diagram of the portable electronic device of FIG. 1 and a transmission receptacle. Referring to FIGS. 1 and 4, the portable electronic device 100 further includes a case 140, which can be plugged into a corresponding transmission receptacle 50 of the portable electronic device 100. The case 140 encloses the first contact-pads 114, the second contact-pads 116, the conductive terminal 130 and the fixing-cover 120. The case 140 and the base material 110 in the case 140 together form a slot 142 therebetween. The first contact-pads 114 and the first ends 132 of the conductive terminals 130 are exposed in the slot 142. The slot 142 allows the contact-pads of the transmission receptacle 50 entering so as to contact the corresponding first contact-pads 114 and the first ends 132 of the corresponding conductive terminals 130. By disposing the case 140, in addition to protecting the components in the case 140, the portable electronic device 100 further assists the user in plugging the portable electronic device 100 into the transmission receptacle 50 in a correct direction so as to achieve foolproof effect.

By means of an appropriate structure design of the conductive terminals 130, the conventional poor contact problem between the conductive terminal 130 and the second contact-pads 116 can be avoided in the invention. The more detailed explanations are described in following.

Figure 5A:
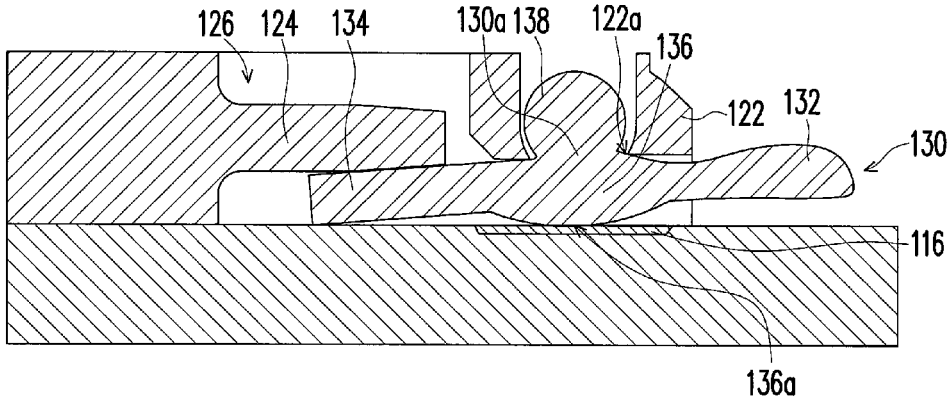
FIG. 5A is a diagram showing an un-operated state of partial parts of the portable electronic device of FIG. 1.

FIG. 5A is a diagram showing an un-operated state of partial parts of the portable electronic device of FIG. 1. Referring to FIGS. 1 and 5A, in the embodiment, both ends 132 and 134 of each the conductive terminal 130 are similar to both ends of a lever and suitable to swing relatively to the base material 110 around the bottom 136*a* of the central portion 136 as a pivot. When the portable electronic device 100 is not plugged into the transmission receptacle 50, the first end 132 of each the conductive terminal 130 is not applied by force and the second end 134 leans against the fixing-cover 120.

Figure 5B:
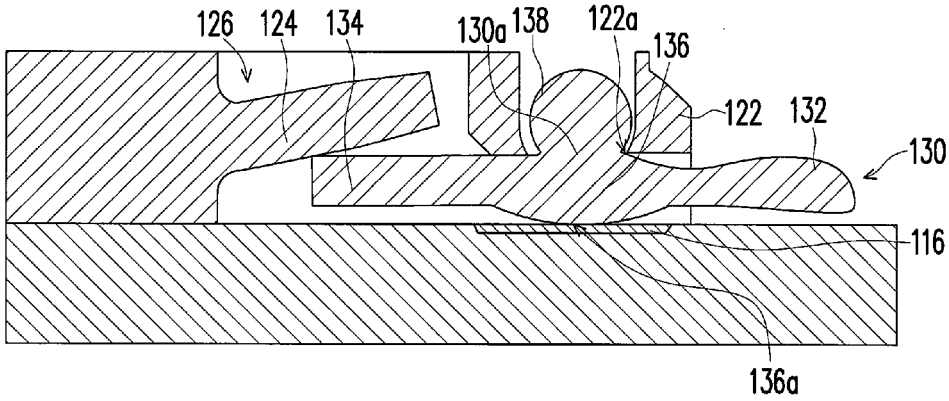
FIG. 5B is a diagram showing an operated state of partial parts of the portable electronic device of FIG. 1.

FIG. 5B is a diagram showing an operated state of partial parts of the portable electronic device of FIG. 1. Referring to FIGS. 1, 4 and 5B, in the embodiment, four first contact-pads 114 together with other five second contact-pads 116 serve as USB 3.0 transmission leads of the portable electronic device 100, in which the five second contact-pads 116 need using the first ends 132 of the conductive terminals 130 for serving as the places contacted with the transmission receptacle 50. Therefore, when the portable electronic device 100 is plugged into the transmission receptacle 50, the transmission receptacle 50 contacts the first ends 132 and applies a force onto the first ends 132, so that each the first end 132 swings relatively to the base material 110 in the direction towards the first surface 112 around the bottom 136*a* of the central portion 136 serving as a pivot. Meanwhile, the second ends 134 of the conductive terminals 130, affected by the swinging of the first ends 132 relatively to the base material 110, make the second ends 134 swing relatively to the base material 110 in the direction towards the fixing-cover 120.

Thereafter, a reaction force applied by the fixing-cover 120 is applied onto the second ends 134 to force the second ends 134 further swinging relatively to the base material 110 in the direction towards the first surface 112, which makes the bottoms 136*a* of the central portions 136 further press down the second contact-pads 116. In this way, when the portable electronic device 100 is plugged into the transmission receptacle 50, the conductive terminals 130 and the second contact-pads 116 keep closed contacts therebetween through the force applied by the transmission receptacle 50 and pressing the first ends 132 of the conductive terminal 130. It should be noted that at the time, the bottoms 136*a* of the central portions 136 and the second contact-pads 116 keep closed contacts therebetween, moreover, the contact area of them can be increased due to the forces applied onto the first ends 132 and the second ends 134. As a result, the conventional poor contact problem between the conductive terminal 130 and the second contact-pads 116 can be avoided and the effective and maintained contact area is advantageous in advancing the transmission rate of the portable electronic device 100 and ensuring the data transmission stability.

In addition, the fixing-cover 120 of the embodiment has a plurality of springs 124 (as shown by FIG. 3). The springs 124 and the fixing-cover 120 are integrated formed. In other embodiments, the springs 124 and the fixing-cover 120 can be separately fabricated. The springs 124 respectively press the second ends 134 of the conductive terminals 130. When the portable electronic device 100 is plugged into the transmission receptacle 50 (as shown by FIG. 5B), the force applied by the transmission receptacle 50 presses the first ends 132 of the conductive terminals 130. After the springs 124 are acted by the upward force of the second ends 134 (far away from the first surface 112), the springs 124 apply a reaction force onto the second ends 134 to force the second ends 134 further swinging relatively to the base material 110 in the direction towards the first surface 112.

The fixing-cover 120 further includes a plurality of grooves 126. The grooves 126 respectively expose the springs 124 and the second ends 134 of the conductive terminals 130 so as to provide the springs 124 with a sufficient swinging space. On the other hand, the positioning portion 138 and the clamp portion 122 in the embodiment have a preserved gap therebetween and the surface of the positioning portion 138 is a curve surface, so that when the conductive terminal 130 swings relatively to the base material 110, the positioning portion 138 is blocked by the clamp portion 122.

Figure 6:
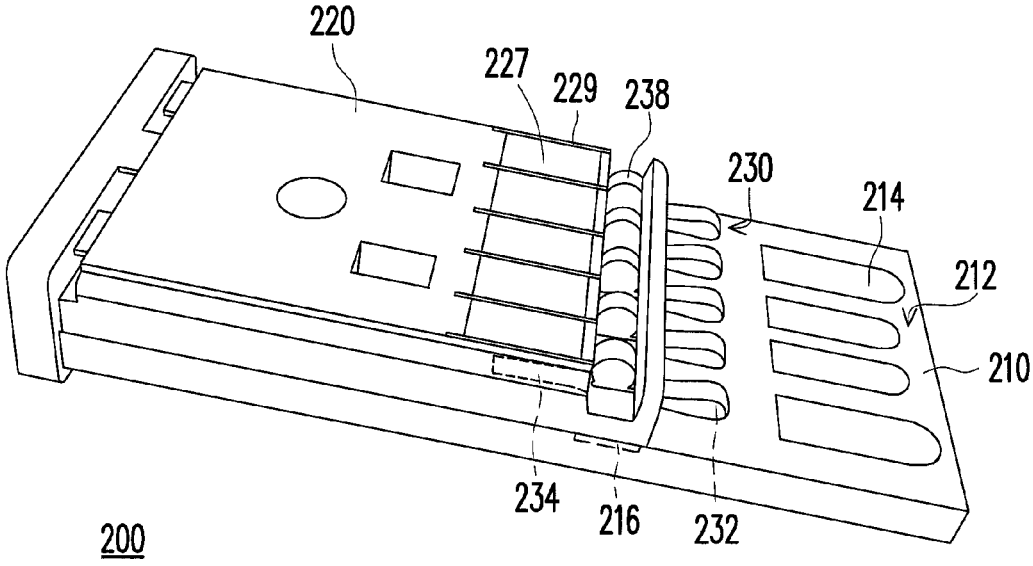
FIG. 6 is a diagram of a three-dimensional diagram of a portable electronic device according to another embodiment of the present invention.

The invention does not limit the structure for the fixing-cover to press the second ends of the conductive terminals. In the following, the implementation is explained by examples associated with figures. FIG. 6 is a diagram of a three-dimensional diagram of a portable electronic device according to another embodiment of the present invention. Referring to FIG. 6, an portable electronic device 200 of the embodiment includes a base material 210, a fixing-cover 220 and a plurality of conductive terminals 230 (five ones are shown).

In the embodiment, the base material 210, the fixing-cover 220 and the conductive terminals 230 have the same or similar functions as the base material, the fixing-cover and the conductive terminals in the first embodiment, and therefore, the structure details, the designs and the actions thereof can be understood referring to FIGS. 1-4 and 5A-5B, which is omitted to describe.

The four first contact-pads 214 of the portable electronic device 200 serve as the USB 2.0 transmission leads, while the four first contact-pads 214 together with other five second contact-pads 216 can further serve as USB 3.0 transmission leads, in which the five second contact-pads 216 are connected to the external transmission receptacle via the contacts between the second contact-pads 216 and the conductive terminals 230.

Figure 7:
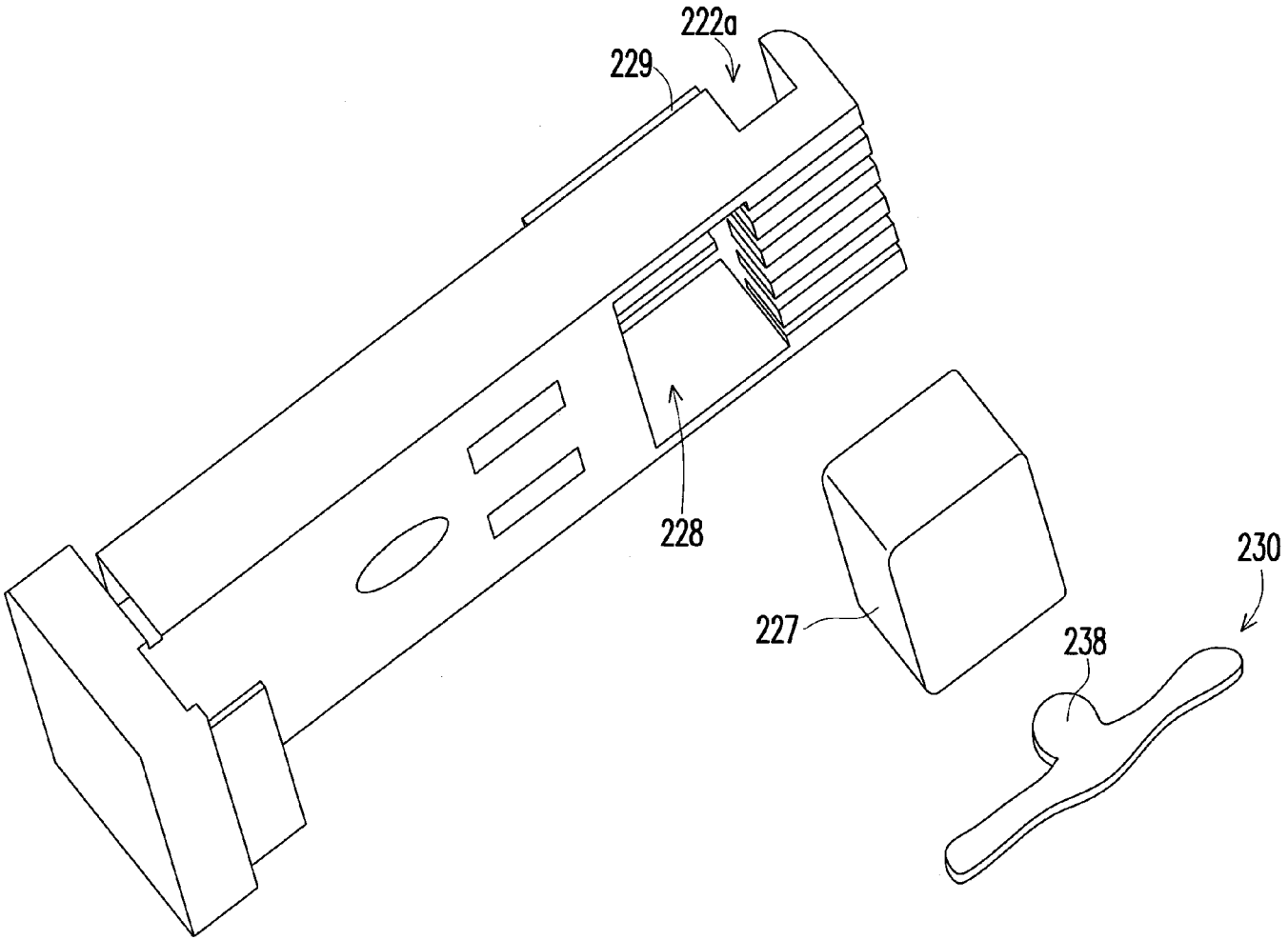
FIG. 7 is an assembling diagram of partial parts of the portable electronic device of FIG. 6.

In the embodiment, the fixing-cover 220 includes a buffering element 227. The buffering element 227 elastically presses the second ends 234 of the conductive terminals 230. When the portable electronic device 200 is plugged into the transmission receptacle 50 (as shown by FIGS. 4 and 5B), the buffering element 227 is acted by an upward force (i.e., apart from the first surface 212) applied by the second ends 234 through the external force applied by the transmission receptacle 50 pressing the first ends 232 of the conductive terminals 230. After that, the buffering element 227, in turn, applies a reaction force onto the second ends 234 to force the second ends 234 swing relatively to the base material 210 in the direction towards the first surface 212 to increase the contact area between the conductive terminals 230 and the second contact-pads 216. It should be noted that the buffering element 227 in the embodiment is made of elastic material, for example, silicon. With such a material, during operating the conductive terminals 230, the poor contact problem between the conductive terminals 230 and the second contact-pads 216 can be avoided through the elasticity of the buffering element 227. On the other hand, the fixing-cover 220 can buffer the vibration or shake produced by swings of the conductive terminals 230 through the buffering element 227. The invention does not limit the assembling method of the buffering element to the portable electronic device. In following, the assembling example is explained associated with figures. FIG. 7 is an assembling diagram of partial parts of the portable electronic device of FIG. 6. Limited by the angle of view, only a part of a fixing element 229 is shown. Referring to FIGS. 6 and 7, the fixing-cover 220 in the embodiment further includes a groove 228 and one or multiple fixing elements 229, the fixing elements 229 of the embodiment are bar-shaped structure and there are six ones shown in the figure. The buffering element 227 in the embodiment is located in the groove 228 and the fixing elements 229 respectively press the buffering element 227 to fix the buffering element 227 in the groove 228 to avoid the buffering element 227 from popping up out of the groove 228.

The fixing elements 229 and the fixing-cover 220 in the embodiment are integrated formed. During assembling the portable electronic device 200 with the buffering element 227, the buffering element 227 is firstly placed in the groove 228, followed by assembling the conductive terminals 230 with the fixing-cover 220. Since the fixing-cover 220 is made of material with plasticity and elasticity, for example, plastic, so that even the external diameter of the conductive terminals 230 is greater than the diameter of the openings 222*a*, the positioning portion 238 still can go through the opening 222*a* by extrusion way to be easier assembled together with the fixing-cover 220. Finally, the base material 210 and the fixing-cover 220 are assembled together to basically finish the assembling flow procedure.

In the above-mentioned assembling flow procedure of the portable electronic device, the fixing elements and the fixing-cover are firstly integrated formed, which the present invention is not limited to, and more examples are described in following.

Figure 8:
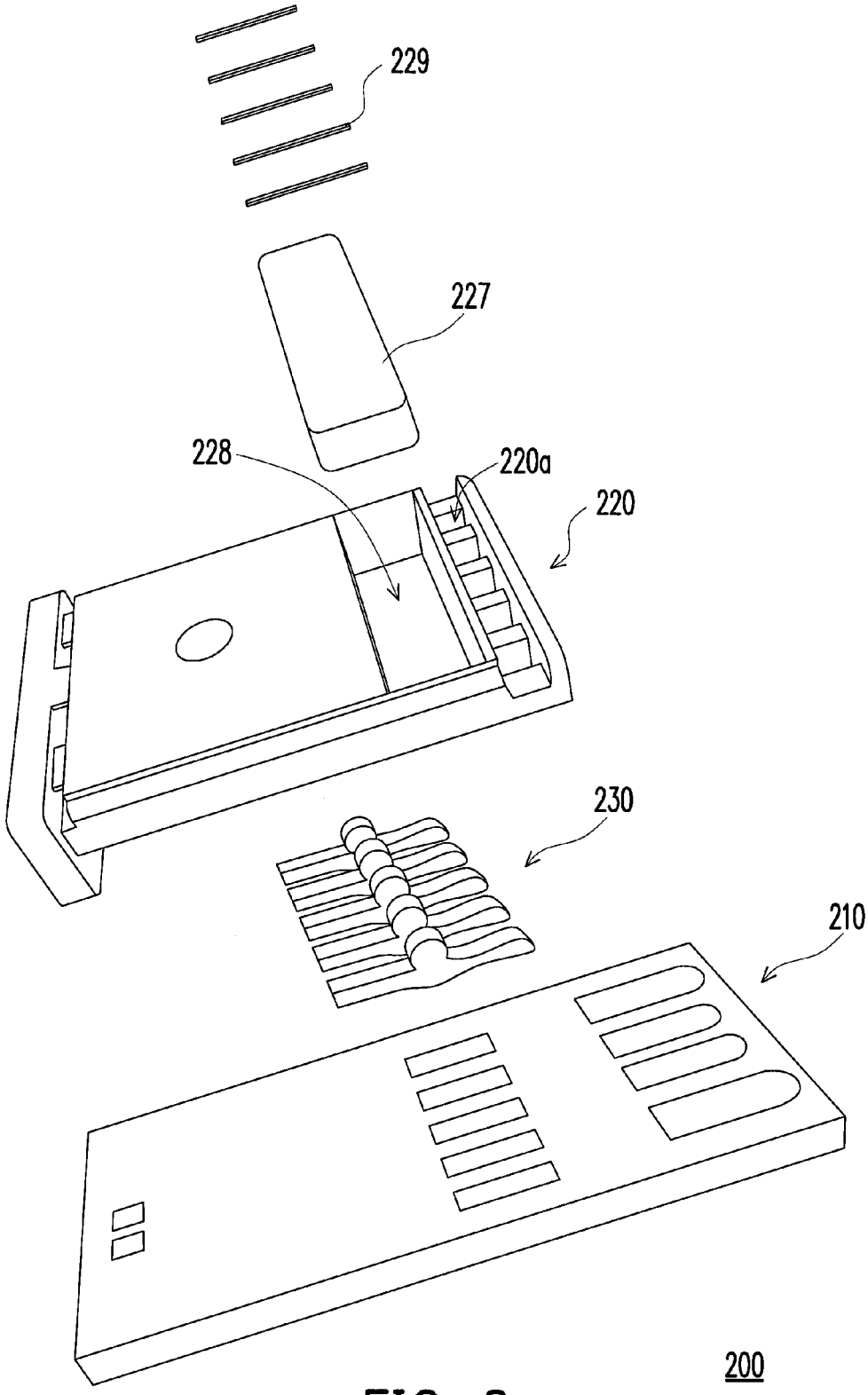
FIG. 8 is an assembling diagram of partial parts of the portable electronic device of FIG. 6.

FIG. 8 is an assembling diagram of partial parts of the portable electronic device of FIG. 6. Referring to FIGS. 6 and 8, the base material 210, the fixing-cover 220 and the conductive terminals 230 in the embodiment are assembled together. Then, the buffering element 227 is placed in the groove 228, followed by assembling the conductive terminals 230 onto the groove 228 of the fixing-cover 220 to fix the buffering element 227 into the groove 228. At the time, the assembling procedure is basically finished. In addition, in other embodiments, the buffering element 227 can be fixed in the groove 228 by using other appropriate structures, which the present invention is not limited to.

Figure 9:
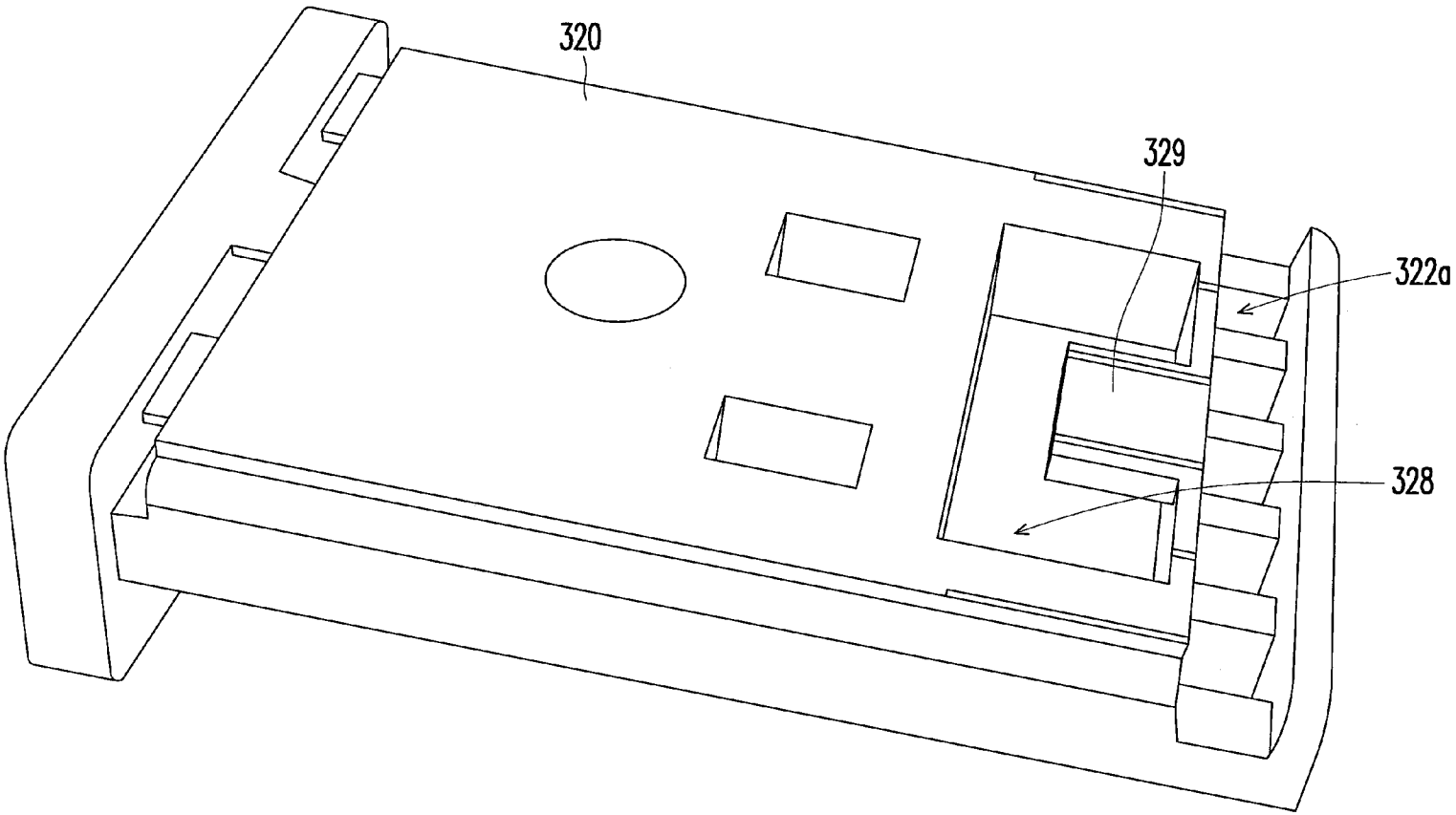
FIG. 9 is a diagram of a three-dimensional diagram of a portable electronic device according to yet another embodiment of the present invention.
Figure 10:
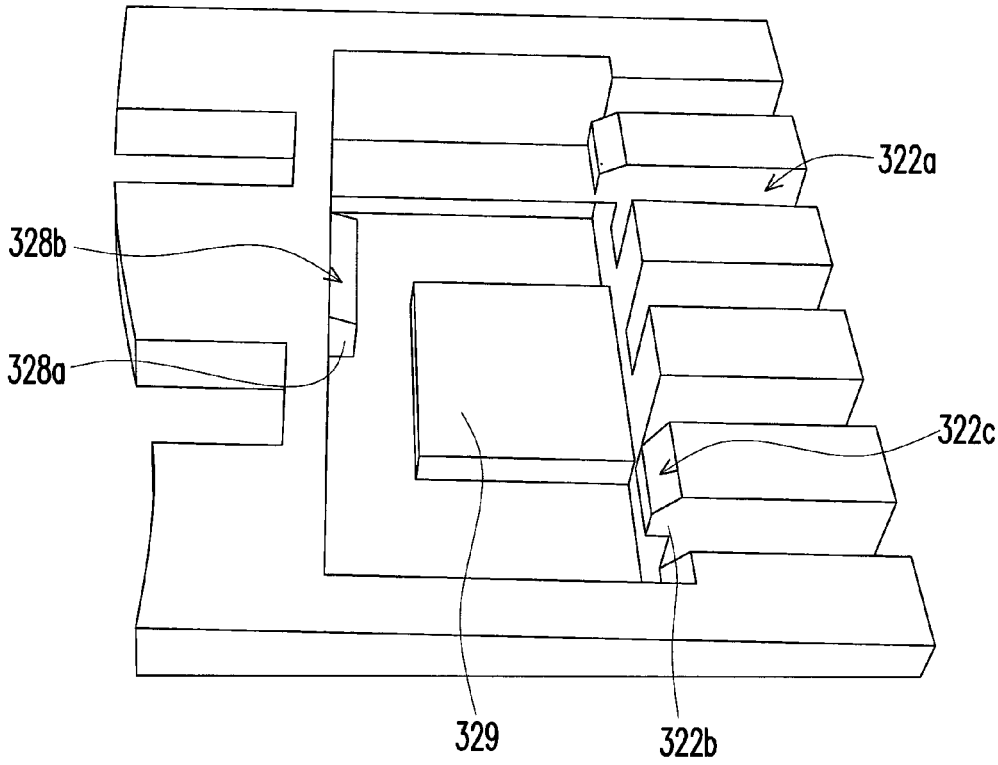
FIG. 10 is a diagram of the fixing-cover of FIG. 9 in another angle of view.

In the embodiment, the invention does not limit the quantity and the shape of the fixing elements and more examples associated with figures are described in following. FIG. 9 is a diagram of a three-dimensional diagram of a portable electronic device according to yet another embodiment of the present invention and FIG. 10 is a diagram of the fixing-cover of FIG. 9 in another angle of view. The fixing-cover in FIGS. 9 and 10 is upside down shown and only the fixing-cover 320 is shown for simplicity. Referring to FIGS. 9 and 10, the unique of the portable electronic device 300 in FIG. 9 from the portable electronic device 200 in FIG. 6 rests in the fixing-cover 320 of FIG. 9 further includes at least one extension portion 328*a*. In the embodiment, only one extension portion 328*a* is shown and the extension portion 328*a* is disposed at a side of the groove 328, and the extension portion 328*a* has a guiding inclined surface 328*b*.

In other embodiments, the extension portion can extend out from other appropriate structures, which the present invention is not limited to. For example, the fixing-cover 320 further includes at least one extension portion 322*b*. The extension portions 322*b* are two and disposed at a side of the groove 328 and adjacent to the opening 322*a*.

Figure 11:
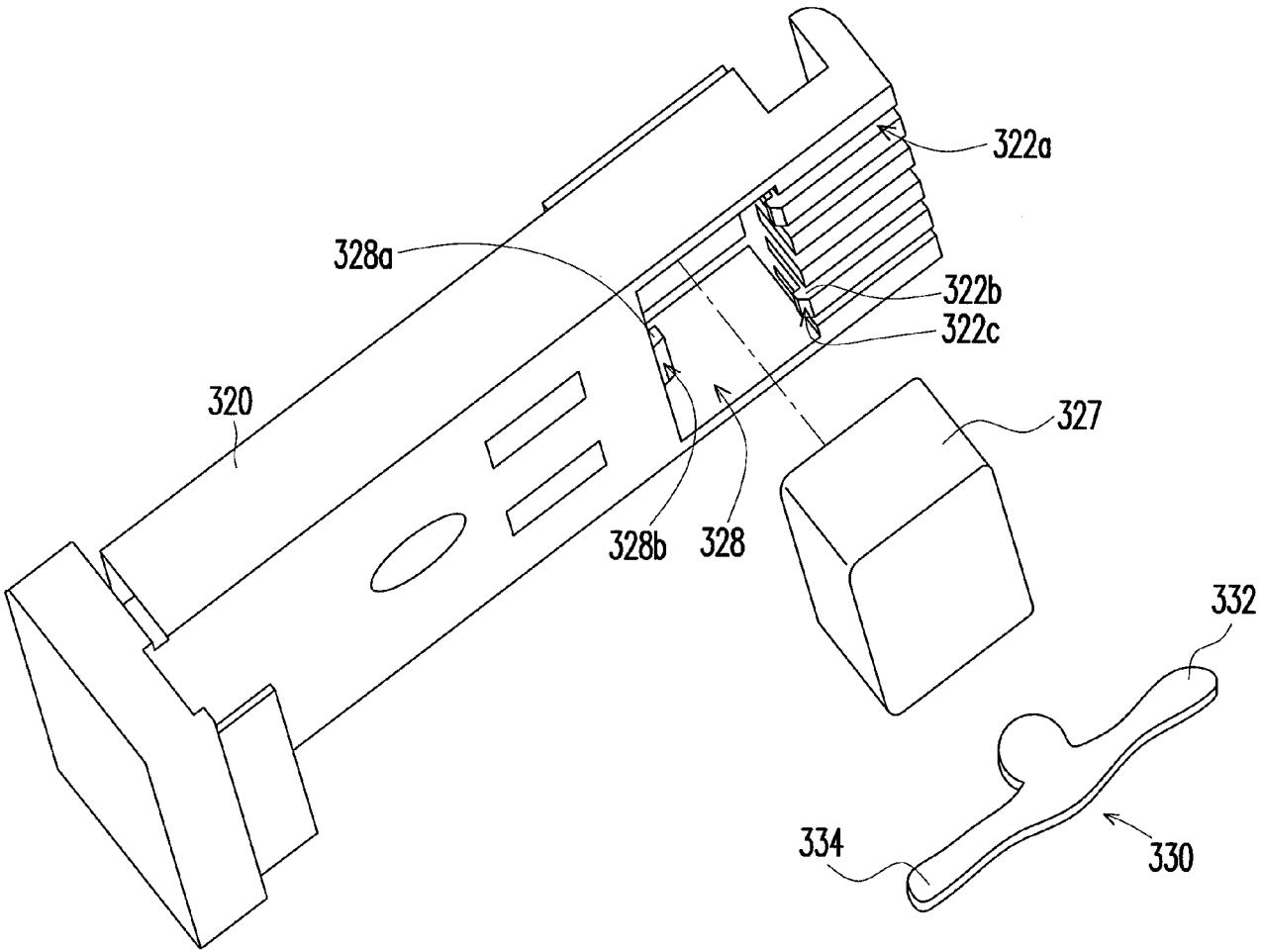
FIG. 11 is an assembling diagram of partial parts of the portable electronic device of FIG. 9.

FIG. 11 is an assembling diagram of partial parts of the portable electronic device of FIG. 9. Referring to FIGS. 9-11, the fixing elements 329 and the fixing-cover 320 in the embodiment are integrated formed. During assembling the portable electronic device 300 with the buffering element 327, the buffering element 327 is firstly placed in the groove 328. Since the extension portion 328*a* and the extension portions 322*b* respectively have a guiding inclined surface 328*b* and guiding inclined surfaces 322*c* by design, the buffering element 327 can easier enter the groove 328 through the guiding of the guiding inclined surface 328*b* and/or the guiding inclined surfaces 322*c*. Thus, in the embodiment, the buffering element 327 can be easier assembled with the fixing-cover 320. In addition, the buffering element 327 of the embodiment can be fixed at the groove 328 through the extension portion 328*a* or/and the extension portions 322*b* to avoid the buffering element 327 from popping up out of the groove 328. After assembling the conductive terminals 330 with the fixing-cover 320, the assembling procedure is basically finished.

In summary, the invention can avoid the poor contact problem between the conductive terminals and the second contact-pads through an appropriate structure design of the conductive terminals. Both ends of each the conductive terminal of the portable electronic device herein are designed similar to both ends of a lever and are suitable to swing relatively to the base material around the bottom of the central portion as a pivot. When the portable electronic device is plugged into a transmission receptacle, an external force applied by the transmission receptacle presses an end of the conductive terminal to make the conductive terminal and the second contact-pad keep close contact. In addition, the contact area between the conductive terminal and the second contact-pad is increased along with the increasing applied force so as to ensure the data transmission stability of the portable electronic device.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A portable electronic device, comprising:

a base material, having a first surface and a plurality of first contact-pads and a plurality of second contact-pads both located on the first surface;

a fixing-cover, disposed on the first surface and exposing the first contact-pads, wherein the fixing-cover has a clamp portion located over the second contact-pads and the clamp portion has a plurality of openings;

a plurality of conductive terminals, respectively disposed on the second contact-pads, wherein each of the conductive terminals comprises:

a first end, extending out of the fixing-cover;

a second end, configured for leaning against the fixing-cover to withstand a press force towards the corresponding second contact-pad; and a central portion, located between the first end and the second end, wherein a bottom of the central portion bulges and contacts the corresponding second contact-pad, and the first end and the second end are configured for swinging relatively to the base material around the bottom of the central portion as a pivot.

2. The portable electronic device as claimed in claim 1, wherein a connection place of the positioning portion and the central portion forms a neck portion and the clamp portion extends towards the neck portion.

3. The portable electronic device as claimed in claim 1, wherein the fixing-cover comprises a plurality of springs respectively pressing the second ends of the conductive terminals.

4. The portable electronic device as claimed in claim 1, wherein the fixing-cover and the springs are integrated formed.

5. The portable electronic device as claimed in claim 3, wherein the fixing-cover further comprises a plurality of grooves and the springs respectively expose the springs and the second end of each of the conductive terminals.

6. The portable electronic device as claimed in claim 1, wherein the fixing-cover comprises a buffering element and the buffering element is able to elastically press the second ends of the conductive terminals.

7. The portable electronic device as claimed in claim 6, wherein the fixing-cover further comprises a groove and the buffering element is located in the groove.

8. The portable electronic device as claimed in claim 7, wherein the fixing-cover further comprises a fixing element and the fixing element presses the buffering element to fix the buffering element into the groove.

9. The portable electronic device as claimed in claim 7, wherein the fixing-cover further comprises at least one extension portion, the at least one extension portion is disposed in the groove, each of the extension portions has a guiding inclined surface, and the buffering element is configured for entering the groove through the guiding of the guiding inclined surface.

10. The portable electronic device as claimed in claim 1, wherein a surface of the positioning portion is a curve surface.

11. The portable electronic device as claimed in claim 1, further comprising a case enclosing the first contact-pads, the second contact-pads, the conductive terminals and the fixing-cover, wherein the case has a slot, and the first contact-pads and the first ends of the conductive terminals are exposed in the slot.

* * * * *